US009173045B2

(12) United States Patent
Bruss et al.

(10) Patent No.: US 9,173,045 B2
(45) Date of Patent: Oct. 27, 2015

(54) HEADPHONE RESPONSE OPTIMIZATION

(71) Applicant: Imation Corp., Oakdale, MN (US)

(72) Inventors: John Bruss, Culver City, CA (US); Douglas K. Hogue, Woodbury, MN (US); Alan Olson, Cottage Grove, MN (US)

(73) Assignee: Imation Corp., Oakdale, MN (US)

( * ) Notice: Subject to any disclaimer, the term of this patent is extended or adjusted under 35 U.S.C. 154(b) by 323 days.

(21) Appl. No.: 13/772,650

(22) Filed: Feb. 21, 2013

(65) Prior Publication Data

US 2013/0216052 A1 Aug. 22, 2013

Related U.S. Application Data

(60) Provisional application No. 61/601,467, filed on Feb. 21, 2012.

(51) Int. Cl.

| | |
|---|---|
| ***H04R 29/00*** | (2006.01) |
| ***H04R 1/10*** | (2006.01) |
| ***H04R 5/02*** | (2006.01) |
| *H04R 5/033* | (2006.01) |

(52) U.S. Cl.

CPC ..... *H04R 29/002* (2013.01); *H04R 1/1091* (2013.01); *H04R 5/02* (2013.01); *H04R 29/001* (2013.01); *H04R 5/033* (2013.01)

(58) Field of Classification Search

None

See application file for complete search history.

(56) References Cited

U.S. PATENT DOCUMENTS

| | | | |
|---|---|---|---|
| 6,311,080 | B1 | 10/2001 | Mochida |
| 6,555,990 | B1 | 4/2003 | Yang |
| 7,888,913 | B1 | 2/2011 | Marty et al. |
| 8,077,872 | B2 | 12/2011 | Dyer et al. |
| 2006/0097699 | A1 | 5/2006 | Kamenoff |
| 2006/0222185 | A1 | 10/2006 | Dyer et al. |
| 2008/0037797 | A1 | 2/2008 | Goldstein et al. |
| 2008/0130916 | A1 | 6/2008 | Kong et al. |
| 2008/0137873 | A1 | 6/2008 | Goldstein |
| 2009/0128097 | A1 | 5/2009 | Esnard |
| 2010/0197280 | A1 | 8/2010 | Hans et al. |
| 2010/0289457 | A1 | 11/2010 | Onnerud et al. |
| 2010/0321193 | A1 | 12/2010 | Liao et al. |

(Continued)

FOREIGN PATENT DOCUMENTS

DE 10102194 * 8/2001

OTHER PUBLICATIONS

U.S. Appl. No. 13/795,307, filed Mar. 12, 2013.

(Continued)

*Primary Examiner* — Regina N Holder

(74) *Attorney, Agent, or Firm* — Dorsey & Whitney LLP

(57) ABSTRACT

Optimized sound waves presented to the listener by headphones, notwithstanding differences in ear geometry and headphone positioning. A test signal causes an acoustic sensor to receive sound waves actually formed in the listener's ear cavity. A response from the sensor is compared with an expected ear cavity transfer function, from which desired adjustments to the audio signal are determined. The audio signal might be received from an application program, calibrated by an interface software element, and adjusted thereby, before forwarding to the headphones. Calibration might be performed from when the headphones are positioned, or dynamically in response to changes in the transfer function.

20 Claims, 2 Drawing Sheets

(56) References Cited

U.S. PATENT DOCUMENTS

| | | | |
|---|---|---|---|
| 2013/0148818 | A1 | 6/2013 | Yamkovoy |
| 2013/0202130 | A1 | 8/2013 | Zurek et al. |

OTHER PUBLICATIONS

U.S. Appl. No. 13/795,143, filed Mar. 12, 2013.

English Translation of DE10102194, published Aug. 30, 2001, titled "Determining position of sound event transferred by headphone, involves generating filter curve from difference between individual transmission measures and reference measure" by Koenig Florian Meinhard (3 pages).

* cited by examiner

HEADPHONE RESPONSE OPTIMIZATION

CROSS-REFERENCE TO RELATED APPLICATIONS

This application claims priority to U.S. Provisional Patent Application No. 61/601,467, filed Feb. 21, 2012, entitled "Headphone Response Optimization," the entire content of which is hereby incorporated by reference in its entirety.

BACKGROUND OF THE DISCLOSURE

Headphones are designed to produce sound waves to be presented to a listener's ear. Those sound waves are produced by a diaphragm, such as for example in a headphone cup. The diaphragm is coupled to a driver, which is responsive to an audio signal. The audio signal is produced by an audio signal source, such as an MP3 player or another entertainment device.

Ideally, the sound waves presented to the listener's ear are faithful to the original audio signal. However, the shape and size of the human ear performs a transfer function on sound waves presented to the outside of the ear. When designed, known headphones are optimized for an ear geometry that is intended to be representative of most human ears, such as for example the KEMAR standard (including the pinna, the outside part of the ear, sometimes referred to as the auricle, and the concha, the bowl-shaped part of the pinna, the latter of which generally forms a cavity for receiving sound waves). Similarly, when designed, known headphones are optimized for an expected position of the headphone with respect to that ear geometry, which is generally responsive to a relative shape of the headphone or its cushion with respect to the shape and size of the ear.

One problem in the known art is that, while designed for a standard ear geometry that is representative of most human ears, known headphones only approximate the actual ear geometry of any particular listener. Most real human ears differ at least somewhat from the standard ear geometry used for design, as a consequence of variation among the ear shapes and sizes of different people. This has the effect that the standard ear geometry will often not be a faithful representation of the listener's actual ear.

Similarly, another problem in the known art is that, while designed for a standard ear geometry that is representative of most human ears, known headphones only approximate the actual position of the headphone with respect to that ear geometry. When in actual use, most real listeners position their headphones at least somewhat differently from the standard used for design, also as a consequence of variation among the ear shapes and sizes of different people, as well as a consequence of variation in the user's choice of headphone position. This also has the effect that the position the headphones were designed for will often not be a faithful representation of the actual position used by the listener. This is also a consequence of variation among different people, their ear shapes and sizes, and the most comfortable position they might individually select for using their headphones.

The known art has the drawback that the sound waves presented to the listener can differ substantially from their ideal presentation, due to the headphones having been designed only for an expected average ear and an expected headphone position.

SUMMARY OF THE DISCLOSURE

We provide techniques for optimizing the sound waves presented to the listener by one or more headphones, notwithstanding differences in ear shape and size and differences in headphone positioning.

A system, including one or more headphones, emits a test signal into the listener's ear (where the listener's ear refers to the chamber defined by the listener's ear and the headphone cup over the ear), measures a response to that test signal, compares that response with an expected response associated with a standard ear geometry, and corrects audio signals later emitted into the ear chamber to account for a result of that comparison.

In one embodiment, the system selects one or more test signals (or determines that one or more listener-selected test signals sufficiently serve at least a portion of that purpose) and causes a speaker diaphragm to emit sound waves according to those one or more test signals into the listener's ear. As described above, the listener's ear (in combination with the headphone and its positioning) performs a transfer function on that test signal.

In one embodiment, the system includes a microphone which performs as an acoustic sensor, which receives a response to that test signal. That response provides sufficient information to determine the transfer function. The system includes a signal processing element, which compares the actual transfer function with an expected transfer function (the latter being associated with a standard ear geometry), determines one or more corrections to be performed on audio signals later emitted into the listener's ear, and performs those corrections. As described herein, audio signal correction can be performed independently for each ear.

In one embodiment, the signal processing element is embedded in the personal media device, and interfaces between an audio signal source (such as an application program on the personal media device) and the audio signals actually presented to the listener's ear.

In the figures, similar components or features might have the same reference label. Similar components or features, or those of the same type, might be distinguished by following the reference label by a dash and a second label that distinguishes them. Where only the first reference label is used, the description is applicable to any similar component having the same first reference label.

DETAILED DESCRIPTION

The ensuing description provides preferred exemplary embodiment(s) only, and is not intended to limit the scope, applicability, or configuration of the disclosure. Rather, the ensuing description of the preferred exemplary embodiment(s) will provide those skilled in the art with an enabling description for implementing a preferred exemplary embodiments of the disclosure. It should be understood that various changes may be made in the function and arrangement of elements without departing from the spirit and scope of the invention as set forth in the appended claims.

Terms and Phrases

The text "personal media device" generally refers to any device capable of accessing media signals and generating audio signals for presentation to a listener. Example personal media devices include smartphones and other devices. Smartphones include, for example, the iPhone™ by Apple Corporation, as well as phones using the Android™ operating system. Other devices include, for example, the iPod™ and iPad™ by Apple Corporation, as well as other touchpads, netbooks, laptops, and personal computers.

Figures and Text

Figure 1:
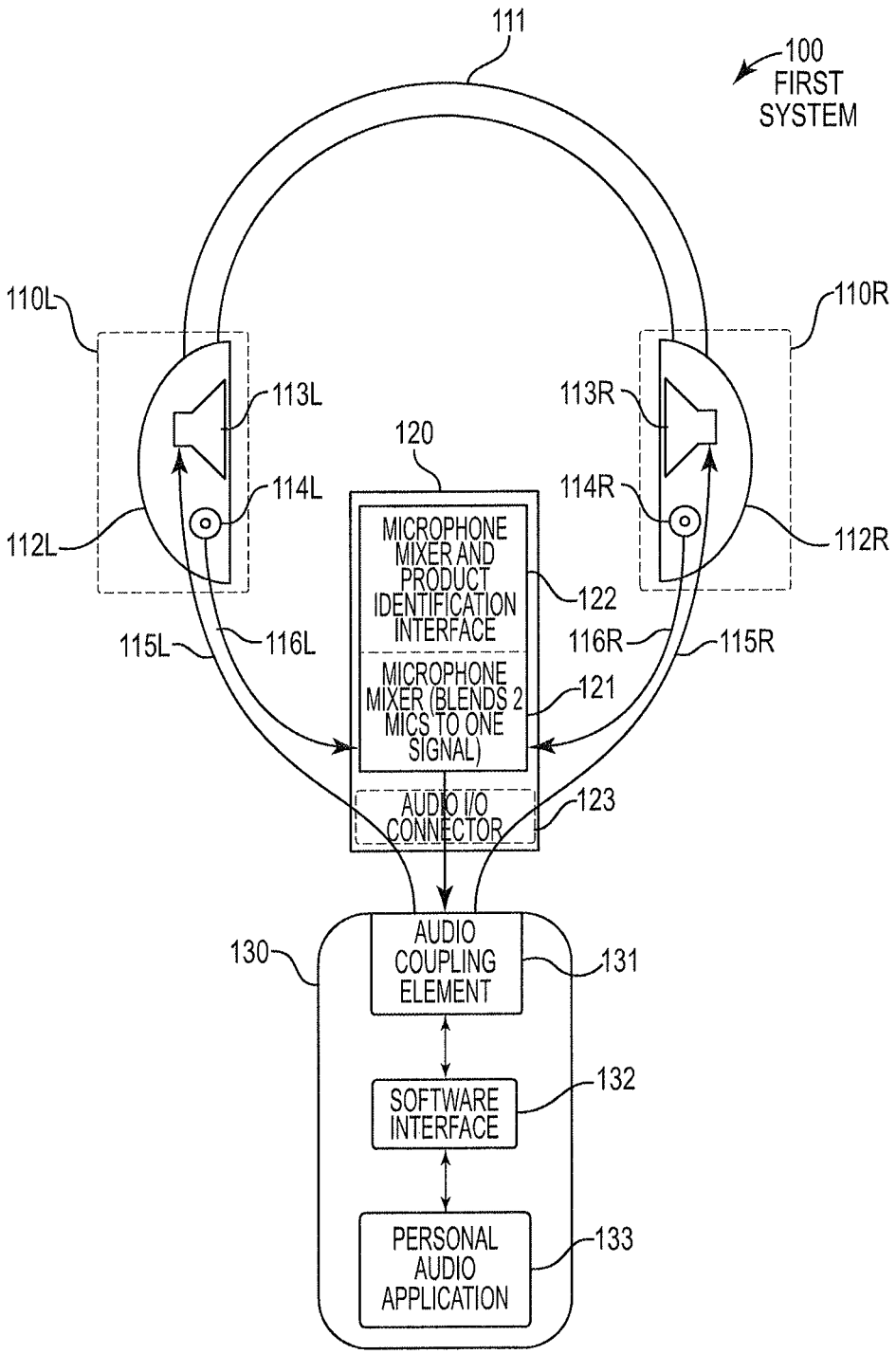
FIG. 1 shows a conceptual drawing of a first audio signal processing system.

FIG. 1 shows a conceptual drawing of a first audio signal processing system.

A first system 100 includes elements shown in the figure, including at least one or more headphones 110, a headphone interface 120, and a personal media device 130. The system 100 can contain other and further components or elements as described herein, not necessarily shown in the figure. Although this application sometimes describes the system 100 with respect to a single listener's ear, in one embodiment there is a similar arrangement disposed for a listener's other ear, such as for example when headphones are matched in an assembly for both ears.

As described herein, the system 100 operates (A) to emit a test signal into the listener's ear, (B) to measure a response to that test signal, (C) to compare that response with an expected response associated with a standard ear geometry and/or headphone position, and (D) to correct audio signals emitted into the listener's ear to account for a result of that comparison, (E) and possibly other functions as described herein. These functions can be performed independently for each ear. As described herein, particular elements of the system 100 operate to perform these functions.

In one embodiment, the personal media device 130 includes a software element which operates to select the test signal, and which communicates that test signal to the headphones 110. The headphones 110 include a speaker which emits that test signal into the listener's ear. The headphones 110 also include a microphone which measures a response to that test signal. The software element at the personal media device 130 compares that response with the expected response, and operates to perform the correction of later audio signals.

Headphone(s)

In one embodiment, the system 100 includes two headphones 110L and 110R respectively for the listener's left and right ears (not shown), coupled to a headpiece 111. The headpiece 111 is capable of being fitted to the listener's head (not shown) and positioning the one or more headphones 110 next to the listener's ears. In one embodiment, the headpiece 111 is adjustable, with the effect that the listener can position the headphones 110L and 110R in their most comfortable locations or as otherwise desired.

In a first set of alternative embodiments, the headpiece 111 only positions one headphone 110 next to one of the listener's ears, possibly leaving the other one of the listener's ears open to ambient sound. In a second set of alternative embodiments, the one or more headphones 110 are positioned next to the listener's ear(s) using additional or alternative techniques.

The headphones 110 each include elements shown in the figure, including at least a headphone cup 112, a speaker 113, and a microphone 114. Each speaker 113 is coupled to a corresponding speaker line 115. Each microphone 114 is coupled to a corresponding microphone line 116.

Each speaker line 115 is coupled to its corresponding speaker 113, with the effect that audio signals on the speaker line 115 (to be presented by the speaker 113) are sent by the personal media device 130 and received by the speaker 113. Similarly, each microphone line 116 is coupled to its corresponding microphone 114, with the effect that audio signals on the microphone line 116 (as measured by the microphone 114) are sent by the microphone 114 and received by the personal media device 130.

In embodiments including two headphones 110L and 110R, each of the headphones 110 includes a corresponding one of the described elements, including a headphone cup 112L and 112R, a speaker 113L and 113R, a microphone 114L and 114R, a speaker line 115L and 115R, and a microphone line 116L and 116R.

Each headphone cup 112 is fitted around its corresponding listener's ear. As described herein, the listener's ear includes both the pinna and the concha. For example, each headphone cup 112 might include a cushion (not shown), is coupled to the headphone cup 112, and which surrounds or otherwise engages the pinna and forms an interface, which may be a relatively sound-tight seal, with the effect that the sound waves emitted from the headphone cup 112 are relatively well-engaged to the concha, without substantial loss or external noise. It is not required that sound emitted by the speaker 113 is the only sound received by the listener's ear. For example, while wearing the headphone, the listener might still be able to hear someone talking to them.

Each speaker 113 is responsive to its corresponding speaker input 115, to receive an audio input signal and to present a sound wave to its corresponding ear. Each microphone 114 is responsive to the sound wave returned from its corresponding ear, to provide a microphone signal corresponding to the audio level of that corresponding sound wave. Where the speaker inputs 115R and 115L differ, such as when presenting stereo output sound to the listener, the microphone signals differ accordingly.

The two speaker lines 115R and 115L are coupled to the headphone interface 120, which provides them to the personal media device 130, as described herein. The two microphone lines 116R and 116L also are coupled to the headphone interface 120, which combines them and provides their combination to the personal media device 130, as described herein.

As noted above, when the headphone cup 112 is placed over the listener's ear, the headphone cup 112 and the listener's ear collectively form a region which effects a transfer function on sound waves. The transfer function operates on those sound waves emitted from a diaphragm of the speaker 113 and received by the listener's ear. As described above, the real transfer function for the particular listener's ear might differ significantly from the transfer function known for the standard ear geometry.

Test Signal(s)

The sound waves emitted by the diaphragm of the speaker 113 provide a test signal, with the effect that the test signal is operated upon by the transfer function described with respect to the combination of the headphone cup 112 and the particular listener's ear. When the test signal is operated upon by the transfer function, the sound waves are altered. As described above, even though the shape of the headphone cup 112 is designed for a standard ear geometry, the real alteration of the test signal will differ, depending upon the shape and size of the particular listener's ear, and depending upon any differences in positioning of the headphone cup 112.

The test signal has properties sufficient to allow a software interface element 132 at the personal media device 130 to determine, at least approximately, a set of adjustments to make to an audio signal. When the adjustments determined by the software interface element 132 are made to the audio signal, as described below, and the particular listener's transfer function is applied, the audio signal will be received by the listener as if the transfer function were equal to the standard ear geometry's known transfer function. This has the effect that listener will hear the audio signal that was intended to be presented to the listener, rather than a version which differs due to differences in the listener's particular ear geometry and/or headphone positioning.

In one embodiment, the test signal might include one or more of the following elements: (A) The test signal might include a first, relatively lower frequency element, such as including frequency components at or below about 200 Hz. (B) The test signal might include a second, relatively higher frequency element, such as including frequency components between about 1,000 Hz to about 5,000 Hz.

While this application describes particular frequencies for each element of the test signal, in the context of the invention, there is no particular requirement for any such limitation. For example, other frequencies, or combinations of frequencies, or other types of signals, might be used in one or more test signals, consistent with the purposes described herein.

In the context of the invention, there is no particular requirement that both elements of the test signal are presented simultaneously, or even nearly so. For example, the test signal might be presented in multiple portions, with distinct frequency components for each portion and possibly even with selected frequency components being presented at more than one time.

In one embodiment, the relatively lower frequency element includes one or more frequency components which measure whether a seal between the headphone cup 112 and the listener's ear is relatively well-established, e.g., not having any substantial gaps, or to monitor for leakage or other artifacts of the cushion seal for the headphones.

For example, leakage of a relatively sound-tight seal between the headphone cup 112 and the listener's ear (such as between the cushion the listener's ear) might be identified by loss of volume in one or more of this set of frequency components. Distinct frequency components might have the effect of providing measurements of different types of leakage or other artifacts.

In one embodiment, the relatively higher frequency element includes one or more frequency components which detect differences between the concha cavity and the equivalent cavity in the KEMAR standard. For example and without limitation, differences between the concha cavity and the equivalent cavity in the KEMAR standard might be identified by differences in frequency amplification (either gain or loss) at one or more of this set of frequency components.

For a first example, one or more frequency components might have the effect of measuring a size of the listener's ear, relative to the standard ear geometry. This would provide information regarding whether the listener's ear is relatively larger or smaller than the standard ear geometry, and if so, by how much. For a second example, one or more frequency components might have the effect of measuring one or more aspects of the shape of the pinna or of other aspects of the listener's ear, or both, relative to the standard ear geometry.

In one embodiment, the test signal might be specifically selected by the system 100. For example and without limitation, the system 100 might select one or more particular multi-frequency signals disposed to include selected frequencies desired for testing. For example, the system 100 might include a memory in which digitized information is maintained which represents a digitized signal. That digitized signal can be converted to an analog signal, which can be used as the test signal.

In alternative embodiments, the system 100 might determine that an audio signal selected by the listener, such as music or otherwise, already includes sufficient information to be used as the test signal. For example, the system 100 might measure one or more selected frequency components of the listener-selected audio signal, and determine whether there is sufficient information present to be used as the test signal.

Some portions of the listener-selected audio signal might be usable as the first, relatively lower frequency element, in whole or in part. Some portions of the listener-selected audio signal might be usable as the second, relatively higher frequency element, in whole or in part. The system 100 might alternatively find it useful or convenient to supplement the listener-selected audio signal with a partial or otherwise supplemental test signal, with the effect of presenting desired frequency components not otherwise present in the listener-selected audio signal.

When the test signal, such as one or more of the test signals described above, is emitted by the speaker 113, the microphone 114 performs as an acoustic sensor, which provides information representative of the actual transfer function performed by the particular listener's ear. As described above, the actual transfer function might differ significantly from the transfer function known for the standard ear geometry. The transfer function performed by a particular listener's ear represents the function applied by the particular listener's ear (in combination with the headphone cup 112 and the speaker 113, including the speaker diaphragm) to an input acoustic wave, to produce an output acoustic wave.

The transfer function might include effects due to at least one or more of (A) the shape and size of the listener's ear, including the listener's pinna and concha, (B) the relative wave-length of the component frequencies of the sound wave, in comparison with the shape and size of the listener's ear cavity, (C) the relatively closed and pressured system of the listener's ear cavity, (D) any acoustic impedance imposed on the headphone speaker diaphragm by the listener's ear cavity, and (E) any air gap, air leakage, or other artifacts of the engagement between the headphone 110 and the listener's ear. While each of these effects is generally accounted for when the headphone is designed for the ear geometry standard, differences between, on the one hand, the shape and size of the particular listener's ear, and on the other hand, the ear geometry standard, will manifest themselves in differences for at least some portion of these effects. The microphone 114 provides a signal which represents the output acoustic wave, thus providing information describing the transfer function.

Optional Ear Correction.

It is possible that the listener will place the headphone cup 112 on the wrong ear, mistakenly matching the right headphone cup 112R with the left listener's ear and the left headphone cup 112L with the right listener's ear. The microphone 114 could be used to detect an orientation the listener's ear, with the effect of determining whether the listener has improperly donned the headphones. In embodiments in which the system 100 detects whether the listener has improperly donned the headphones, the system 100 can exchange the left-ear and right-ear signals. Exchanging the left-ear and right-ear signals corrects this issue.

Headphone Interface

The headphone interface 120 includes elements shown in the figure, including a mixer 121, a product identification interface 122, and an audio input/output connector 123.

In one embodiment, the mixer 121 sums the signals from the microphone outputs 116R and 116L, with the effect of providing a summed microphone signal. While this application primarily describes a mixer 121 which provides a summed microphone signal, in the context of the invention, there is no particular requirement for any such limitation. For example, the mixer 121 could provide a combined signal from which each independent microphone 114R and 114L could be separated. Also for example, as described with respect to FIG. 2, the signals from each microphone 114R and 114L could be independently communicated to the personal media device 130 for later audio correction. In the context of the invention, there is no particular requirement to combine signals from both ears; instead, it is possible to receive signals, and to correct audio signals, separately for each ear, or for one ear.

The product identification interface 122 provides the personal media device 130 with information about the particular model of headphones 110, with the effect that the personal media device 130 can determine how much to adjust the audio signal to have the desired effect. In one embodiment, the product identification interface 122 includes a memory maintaining the information about the particular model of headphones 110.

The audio input/output connector 123 includes a connector which is electrically and mechanically coupleable to the personal media device 130. In one embodiment, the audio input/output connector 123 includes a headphone jack, such as a 3.5 mm TRRS (tip, ring, ring, sleeve) connector, which is capable of providing two speaker signals output from the personal media device 130 and coupleable to the speaker inputs 115L and 115R, and capable of providing a microphone signal output from the headphone interface 120 and input to personal media device 130.

The summed microphone signal is communicated to the audio input/output connector 123, with the effect of providing a microphone signal to the personal media device 130. The two speaker inputs 115R and 115L are coupled to the audio input/output connector 123, with the effect of providing stereo output from the personal media device 130.

The summed microphone signal is communicated to an audio input of the personal media device 130, with the effect that the personal media device 130 can determine a particular acoustic sound wave measured by one of the microphones 114. In one embodiment, as described herein, the personal media device 130 can distinguish between microphone signals for the listener's two ears by coupling only one of the speaker inputs 115R or 115L at a time, with the effect of limiting the summed microphone signal to only one of the microphone outputs 116R and 116L at a time.

Personal Media Device

The personal media device 130 includes elements shown in the figure, including at least an audio coupling element 131, a software interface element 132, and a personal audio application 133. The personal media device 130 includes one or more processors (not shown), and has access to one or more memories or storage devices (not shown).

The one or more processors accessible by the personal media device 130 might include one or more digital processors, such as devices made by ARM™ or Intel™. The one or more memories or storage devices might include any form of memory device or mass storage device coupleable to the personal media device 130. The personal media device 130 might also maintain digital information in memories or storage devices accessible by the personal media device 130 using a wired or wireless communication network.

The audio coupling element 131 is disposed for connection with the audio input/output connector 123. In one embodiment, the audio coupling element 131 includes a headphone jack connector coupleable to a 3.5 mm TRRS coupling element, with the effect of being coupleable to the audio input/output connector 123.

The personal audio application 133 includes either a set of operating system instructions, or a set of application program instructions executing under control of those operating system instructions, to provide an audio signal intended for presentation to the listener. For example, the personal audio application 133 might include the iTunes™ program available from Apple Corporation, or a program with relatively similar capabilities. The personal audio application 133 is coupled to a set of coded audio, and provides an audio signal in response to that coded audio. For a first example, the coded audio includes a set of digitized audio signals maintained in a memory accessible by the personal media device 130, such as an MP3 file. For a second example, the coded audio includes a set of audio signals received in streaming form using a wired or wireless connection by the personal media device 130, such as a streaming audio file, whether real-time or prerecorded.

Software Interface Element

The software interface element 132 is coupled to the audio coupling element 131 and to the personal audio application 133. The software interface element 132 operates under control of program instructions to perform functions as described in this application. In those cases where those program instructions are not described in detail, those skilled in the art, after reading this application, would understand the particular techniques, computations, and program instructions, and would be able to make and use the same, without undue experimentation or further invention.

The software interface element 132, using the processing capability of the personal media device 130, performs signal processing described herein, to adjust the stereo output from the personal media device 130. Using the processing capability of the personal media device 130 has the effect that the software interface element 132 can perform general digital signal processing operations on microphone signals incoming to the personal media device 130 and on speaker signals outgoing from the personal media device 130.

In one embodiment, the software interface element 132 operates to perform functions of controlling the headphones 110, including the speaker 113, microphone 114, and audio signals. Where the system 100 is described as performing control functions, these functions are generally performed by the software interface element 132.

In one embodiment, the software interface element 132 selects the one or more test signals described herein, or alternatively, approves audio signals from the personal audio application 133 as being sufficient to use as the test signals, or at least a portion thereof. The software interface element 132 directs the test signals to the speaker 113. In embodiments including two headphones 110R and 110L, the software interface element 132 directs the test signals to each speaker 113R and 113L.

In one embodiment, the software interface element 132 receives the response measured by the microphone 114. In embodiments including two headphones 110R and 110L, the software interface element 132 receives the response from each microphone 114R and 114L. In embodiments, as described herein, where the signals from the two microphones 114R and 114L are summed, the software interface element 132 sends a first set of test signals to the right-hand speaker 113R and receives a response from its corresponding microphone 114R, and sends a second set of test signals to the left-hand speaker 113L and receives a response from its corresponding microphone 114L.

In one embodiment, the software interface element 132 compares the response measured by the microphone 114 with the expected response from the standard ear geometry. More specifically, the software interface element 132 compares, on the one hand, the transfer function provided in response to the test signal by the listener's ear, with, on the other hand, an expected transfer function associated with a standard ear geometry. The software interface element 132 has access to the expected transfer function, such as, for example, by that expected transfer function being maintained in a memory accessible to the personal media device 130. In embodiments including two headphones 110R and 110L, the software interface element 132 can compare the measured response independently for each ear.

In one embodiment, the software interface element 132 determines a correction to be applied to the audio signal from the personal audio application 133. The software interface element 132 performs digital signal processing in response to the comparison it made between, on one hand the transfer function provided in response to the test signal by the listener's ear, with, on the other hand, an expected transfer function associated with a standard ear geometry. In embodiments including two headphones 110R and 110L, the software interface element 132 can determine the measured response independently for each ear.

In one embodiment, the software interface element 132 selects one or more equalization functions to be applied to the audio signal from the personal audio application 133. For example, the software interface element 132 can apply, digitally, the functions of a parametric equalization filter, or another type of filter, to the audio signal from the personal audio application 133. In embodiments including two headphones 110R and 110L, the software interface element 132 can determine the correction to apply independently for each ear.

In embodiments which include one or more analog devices supplementing the signal processing operations of the personal media device 130 (such as those described with respect to FIG. 2), the software interface element 132 might generate one or more control signals for those analog devices. For example, the software interface element number 132 might select one or more sets of parameters for those analog devices. These parameters might include one more sets of parameters for a parametric equalization filter, or another type of filter, to be applied by those one or more analog devices.

In one embodiment, the software interface element 132 determines, in response to the signal from the microphone 114, a relative size of the listener's ear, as compared with the standard ear geometry. Having determined that relative size, the software interface element 132 classifies that relative size into one of a pre-selected set of possibilities. For example, the software interface element 132 might classify that relative size into one of a set of approximately fifteen to twenty possibilities. Having classified that relative size, the software interface element 132 determines an associated correction to the audio signal by reference to a lookup table. The lookup table includes an associated correction for each such relative size.

System Calibration

In one embodiment, system 100 performs calibration of the headphone 110 as the correction to the audio signal. When the listener dons the headphone 110, either for one ear or for both ears, different placement of each headphone 110 on the listener's ear can result in a different transfer function by the combination of the headphone 110 and the ear. For a first example, the headphone 110 might form an imperfect seal with the ear. For a second example, the headphone 110 might be placed so the diaphragm of the speaker 113 is positioned differently with respect to the ear. In such embodiments, the system 100 can perform calibration in response to positioning of the headphone 110 with respect to the ear. In embodiments with two headphones 110R and 110L, the system 100 can perform calibration independently in response to positioning of each headphone 110R and 110L with respect to its corresponding ear. The system 100 can perform calibration either as an initial step when the headphones 110 are donned, or dynamically re-perform calibration from time to time.

Calibration Step.

In one embodiment, the system 100 performs a calibration step in response to placement of the headphone 110 on the listener's ear. Once calibrated, the listener can enjoy sound waves as provided in response to the audio signal as adjusted by the software interface element 131, with the effect that the headphone 110 is automatically adjusted to the listener's individual and particular ear geometry, even when the listener's ear geometry does not match the standard.

Dynamic Calibration.

In alternative embodiments, the system 100 may, from time to time (such as, for example, periodically or otherwise), dynamically re-perform the calibration step. For example, the diaphragm of the speaker 113 may re-present one or more test signals to the listener's ear from time to time. For example, this might have the effect of gleaning information, or further information, regarding the placement, or adjusted placement, of the headphone 110 relative to the listener's ear. If the headphone 110 has moved relative to the listener's ear, such as for example with the effect of breaking a seal between the headphone cushion 112 and the listener's ear, the software interface element 132 may re-determine what adjustments are desirable with respect to the audio signal.

This has the effect that the headphone 110 (including the speaker 113 and the microphone 114), along with its engagement to the listener's ear, collectively with the software interface element 132, form a circuit which measures the transfer function performed by the coupling between the headphone 110 and the listener's ear, compares that transfer function with one that is associated with a standard ear geometry, and corrects input audio signals so that the listener is able to receive the input audio signal under superior conditions.

Second System

Figure 2:
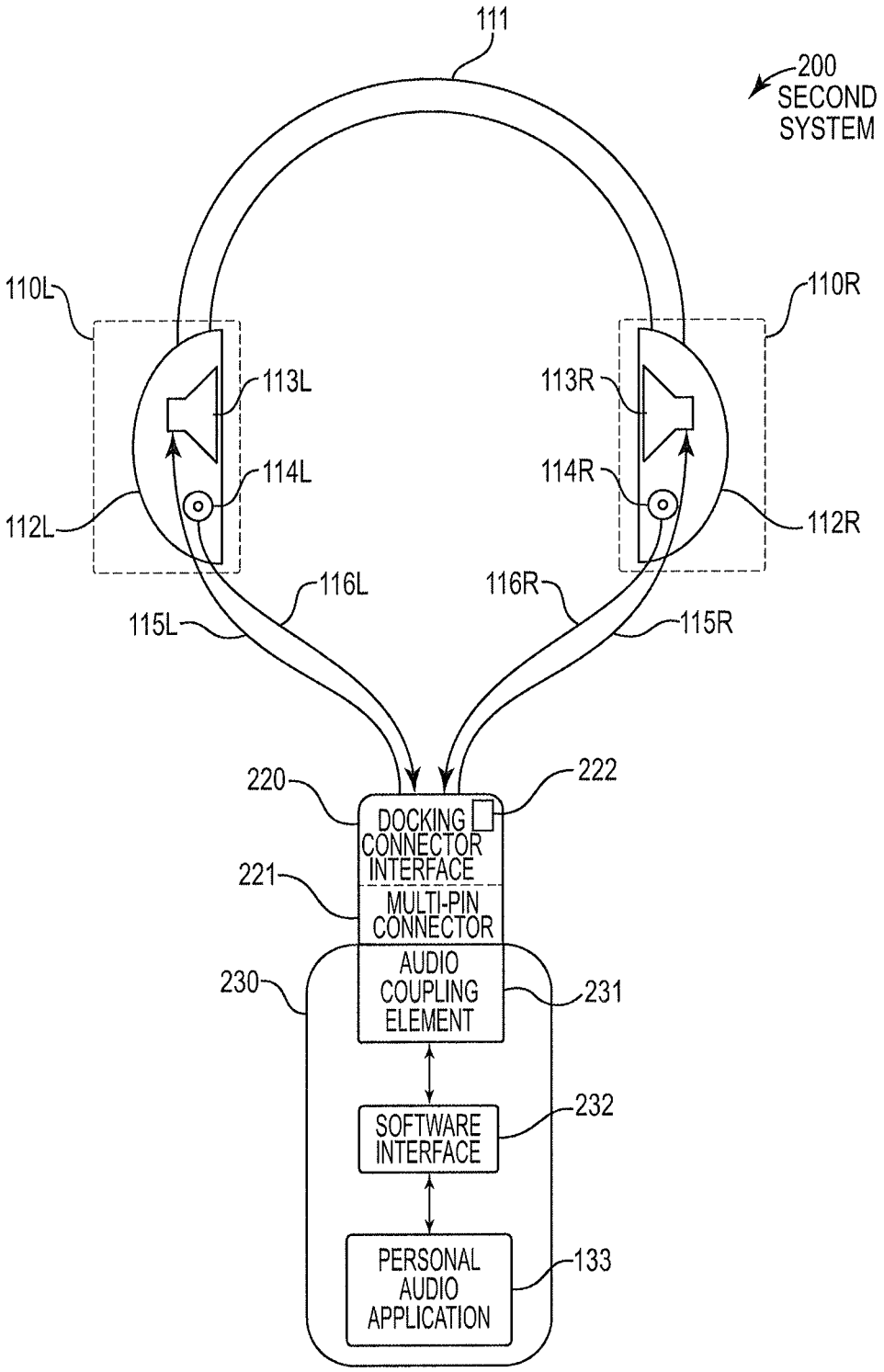
FIG. 2 shows a conceptual drawing of a second audio signal processing system.

FIG. 2 shows a conceptual drawing of a second audio signal processing system.

A second system 200 includes elements shown in the figure, including at least one or more headphones 110, a docking interface 220, and a personal media device 230. The system 100 can contain other and further components or elements as described herein, not necessarily shown in the figures.

The second system 200 includes one or more headphones 110 similar to those described with respect to the first system 100.

The second system 200 includes a personal media device 230 similar to the personal media device 130 described with respect to the first system 100, with at least the difference that the audio coupling element 231 is disposed for coupling to the docking interface 220 (as described below), rather than for coupling to the headphone interface 120 (as described with respect to the first system 100). The software interface element 232 in the personal media device 230 is disposed at least for operation with the docking interface 220.

Operation of the second system 200 is similar to operation of the first system 100, with at least the difference that the docking interface 220 and the audio coupling element 231 operate differently from the headphone interface 120. The docking interface 220 and the audio coupling element 231 operate in conjunction with the software interface element 232, with the effect that the software interface element 232 can make use of analog circuits in the docking interface 220.

Docking Interface

The docking interface 220 includes elements shown in the figure, including at least a multi-pin connector 221 and an (optional) set of one or more analog circuits 222.

In one embodiment, the docking interface 220 is capable of separately coupling the speaker signals outbound from the personal media device 230, capable of separately coupling the microphone signals inbound to the personal media device 230, and is coupleable to the personal media device 230 at a related audio coupling device 231.

In one embodiment, the multi-pin connector 221 includes a standard 30-pin connector used with iPhone™ products from Apple Computer. In alternative embodiments, the docking interface 220 includes other types of connectors which might be compatible with Android™ type devices or other devices. In the standard 30-pin connector, and in related types of connectors, the signals from the microphones 114R and 114L are independently coupled to the personal media device 130. This has the effect that the personal media device 130 can independently examine the signals from the microphones 114R and 114L, independently determine the transfer function for each ear, and independently correct the audio signal for each ear. In embodiments using the standard 30-pin connector, and in related types of connectors, there is no requirement to sum the signals from the microphones 114R and 114L.

Correspondingly, in the personal media device 230, the audio coupling element 231 is disposed for connection with the multi-pin connector 221. In one embodiment, the audio coupling element 231 includes a corresponding connector coupleable to the multi-pin connector 221.

In one embodiment, the one or more analog circuits 222 are embodied in the docking interface 220, and are digitally controllable by the software interface element 232 in the personal media device 230. The one or more analog circuits 222 might include a set of multiple analog audio correctors (for adjusting audio signal) which the software interface element 232 can select from.

For example, the multiple analog equalizers could include individual audio correctors, each of which adjusts the audio signal differently. This has the effect that the software interface element 232 can select one of the multiple analog equalizers to select how to adjust the audio signal.

Similar to the first system 100, in the second system 200, the software interface element 232 controls the docking interface 220 to send signals to the speaker 113 and to receive signals from the microphone 114. This has the effect that the software interface element 232 can send selected test signals (or allow signals from the personal media application 133 to serve as test signals) to the speaker 113, and can receive the response to those test signals as measured by the microphone 114.

Similar to the first system 100, in the second system 200, the software interface element 232 compares the response measured by the microphone 114 with the expected response from the standard ear geometry. Similar to the first system 100, in the second system 200, the software interface element 232 determines from the comparison of responses, any differences between, on the one hand, the real transfer function generated by the combination of the headphone 110 and the actual listener's ear, with, on the other hand, the expected transfer function associated with a standard ear geometry.

Similar to the first system 100, in the second system 200, the software interface element 232 determines, from those differences, a correction to be applied to the audio signal from the personal audio application 133. Similar to the first system 100, in the second system 200, the software interface element 132 performs digital signal processing in response to the comparison.

Similar to the first system 100, in the second system 200, the software interface element 232 adjusts the audio signals from the personal media application 133. As described above, the software interface element 232 can perform digital signal processing to adjust those audio signals.

As described above, in embodiments which include one or more analog circuits 222, the software interface element 232 generates one or more control signals for those analog circuits 222. For example, the software interface element number 232 select one or more sets of parameters for those analog devices. These parameters might include one more sets of parameters for a parametric equalization filter, or another type of filter, to be applied by those one or more analog devices.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, and procedures which, although not explicitly shown or described herein, embody the principles of the disclosure and can be thus within the spirit and scope of the disclosure. Various different exemplary embodiments can be used together with one another, as well as interchangeably therewith, as should be understood by those having ordinary skill in the art. It should be understood that the exemplary procedures described herein can be stored on any computer accessible medium, including a hard drive, RAM, ROM, removable disks, CD-ROM, memory sticks, etc., and executed by a processing arrangement and/or computing arrangement which can be and/or include a hardware processors, microprocessor, mini, macro, mainframe, etc., including a plurality and/or combination thereof. In addition, certain terms used in the present disclosure, including the specification, drawings and numbered paragraphs thereof, can be used synonymously in certain instances, including, but not limited to, e.g., data and information. It should be understood that, while these words, and/or other words that can be synonymous to one another, can be used synonymously herein, that there can be instances when such words can be intended to not be used synonymously. Further, to the extent that the prior art knowledge has not been explicitly incorporated by reference herein above, it is explicitly incorporated herein in its entirety. All publications referenced are incorporated herein by reference in their entireties.

The invention claimed is:

1. A method, including the steps of:

emitting a test sound wave from a headphone into an ear of a listener;

receiving, by a sensor, a response to said test sound wave;

comparing said response to an expected response to said test sound wave, wherein the expected response is associated with a standard ear geometry;

determining differences between said response and said expected response; and adjusting an input audio signal to the headphone in response to said differences, wherein the input audio signal is corrected to account for a result of comparing said response to the expected response associated with the standard ear geometry.

2. The method of claim 1, wherein said expected response is responsive to the standard ear geometry and an expected headphone position with respect to the standard ear geometry.

3. The method of claim 1, including steps of:

emitting a second test sound wave into a second ear of said listener;

comparing a response to said second test sound wave to an expected response to said second test sound wave;

determining differences between said second response and said second expected response; and adjusting an input audio signal to said second ear in response to said differences.

4. The method of claim 3, wherein said steps of emitting a test sound wave from a headphone into an ear of a listener, comparing said response to an expected response to said test sound wave, and determining differences between said response and said expected response are performed at distinct times from said steps of emitting a second test sound wave into a second ear of said listener, comparing a response to said second test sound wave to an expected response to said second test sound wave, and determining any differences between said second response and said second expected response.

5. The method of claim 3, wherein said steps of emitting a test sound wave from a headphone into an ear of a listener, comparing said response to an expected response to said test sound wave, and determining differences between said response and said expected response are performed concurrently with said steps of emitting a second test sound wave into a second ear of said listener, comparing a response to said second test sound wave to an expected response to said second test sound wave, and determining differences between said second response and said second expected response.

6. The method of claim 3, including steps of distinguishing between said response to said test sound wave and said response to said second test sound wave, and adjusting an input audio signal to correct for positioning of said headphone.

7. The method of claim 3, including steps of mixing said response to said test sound wave emitted into said ear and said response to said second test sound wave emitted into said second ear, with the effect of providing a summed microphone signal, and providing the summed microphone signal to a personal media device.

8. The method of claim 1, including steps of:

measuring selected frequency components of listener-selected audio signals;

determining that the audio signal selected by the listener are sufficient for said step of comparing said response to the expected response, wherein there is sufficient information present in the listener-selected audio signals to be used as the test signal.

9. The method of claim 1, wherein:

said test sound wave includes one or more frequencies responsive to an interface between a headphone cup and the listener's ear, wherein the headphone cup and the listener's ear collectively form a region which effects a transfer function that differs from a known transfer function for the standard ear geometry; and the transfer function is applied when adjusting the input audio signal so that the audio signal will be received by the listener as if particular transfer function were equal to the known transfer function of the standard ear geometry.

10. The method of claim 1, wherein said test sound waves include one or more frequencies responsive to a size of the listener's ear and a relatively higher frequency component which detects differences between a concha cavity of the listener's ear and an equivalent cavity in the standard ear geometry.

11. Apparatus including:

a headphone including a speaker and an acoustic sensor, the acoustic sensor being disposed to receive sound waves present in the headphone;

a processor coupled to the speaker and having access to non-transitory instructions directing the processor to cause the speaker to emit a test sound wave, the instructions directing the processor to cause the acoustic sensor to measure a response to the test sound wave;

a comparator disposed to determine differences between the response and an expected response to the test sound wave, wherein the expected response is associated with a standard ear geometry; and a circuit disposed to adjust an input audio signal to the headphone in response to the differences, wherein the input audio signal is corrected to account for a result of comparing said response to the expected response associated with the standard ear geometry.

12. Apparatus as in claim 11, wherein:

the acoustic sensor provides sufficient information to determine a transfer function of a listener's ear, the transfer function differing from a known transfer function for the standard ear geometry; and the circuit applies the transfer function to adjust the input audio signal so that the audio signal will be received by the listener as if the transfer function were equal to the known transfer function of the standard ear geometry.

13. Apparatus as in claim 11, wherein the acoustic sensor provides sufficient information to determine an interface between the headphone and a listener's ear, wherein a multi-frequency signal is selected such that one or more frequency components have the effect of measuring a size of the listener's ear relative to the standard ear geometry and a relatively higher frequency component has the effect of measuring a shape of the listener's ear relative to the standard ear geometry.

14. Apparatus as in claim 11, wherein the processor is disposed in a personal media device coupleable to said headphone and to a media player on the personal media device, and wherein processing capability on the personal media device performs signal processing to adjust the input audio signal to the headphone.

15. Apparatus as in claim 11, including a mixer coupled to the headphone and to a second headphone, wherein the second headphone includes a speaker and an acoustic sensor disposed to receive sound waves present in the second headphone, and wherein the mixer provides a summed microphone signal.

16. Apparatus as in claim 15, including a de-mixer coupled to the mixer, the de-mixer providing individual signals from the headphone and from the second headphone, wherein audio signal correction is performed independently for each ear of a listener.

17. Apparatus as in claim 15, wherein the instructions direct the processor to distinguish between the expected response from a first headphone and from a second headphone, and the instructions direct the processor to adjust an input audio signal to correct for positioning of the headphones independently for each ear of a listener.

18. Apparatus as in claim 11, wherein the instructions direct the processor to measure selected frequency components of listener-selected audio signals to determine whether the audio signals selected by the listener are sufficient for said comparator to determine said differences between said response and said expected response to the test sound wave, such that the audio signals selected by the listener are sufficient for the test sound waves.

19. Apparatus as in claim 11, wherein the test sound wave includes one or more frequencies responsive to a listener's ear size relative to the standard ear geometry, and further comprising a lookup table for determining an associated correction to the input audio signal.

20. A headphone system comprising:

first and second speakers configured to emit test sound waves into each ear of a listener;

first and second microphones configured to receive responses to the test sound waves, wherein transfer functions operate on the test sound waves received by each of the listener's ears;

a comparator configured to determine differences between the responses and expected responses associated with a standard ear geometry and headphone position, depending upon shape and size of the listener's ears; and a processor configured to apply the transfer functions to adjust input audio signals to the first and second speakers in response to the differences, wherein the transfer functions differ from known transfer functions for the standard ear geometry and headphone position, such that the input audio signals are independently corrected for each of the listener's ears.

* * * * *

UNITED STATES PATENT AND TRADEMARK OFFICE

CERTIFICATE OF CORRECTION

PATENT NO. : 9,173,045 B2
APPLICATION NO. : 13/772650
DATED : October 27, 2015
INVENTOR(S) : Bruss et al.

It is certified that error appears in the above-identified patent and that said Letters Patent is hereby corrected as shown below:

Specification

At column 6, line 26:
"wave-length of the component"

should read:
--wavelength of the component--

Claims

At column 13, line 11 (Claim 4, Line 9):
"and determining any differences"

should read:
--and determining differences--

At column 14, line 60 (Claim 18, Line 8):
"for the test sound waves."

should read:
--for the test sound wave.--

Signed and Sealed this
First Day of March, 2016

Michelle K. Lee

Michelle K. Lee
*Director of the United States Patent and Trademark Office*